US010813522B2

(12) United States Patent
Reccanello

(10) Patent No.: US 10,813,522 B2
(45) Date of Patent: Oct. 27, 2020

(54) SURFACE TREATMENT MACHINE WITH FLOW-RATE CONTROL

(71) Applicant: IP CLEANING S.R.L., Portogruaro (IT)

(72) Inventor: Francesco Reccanello, Padua (IT)

(73) Assignee: IP CLEANING S.R.L., Portogruaro (IT)

( * ) Notice: Subject to any disclaimer, the term of this patent is extended or adjusted under 35 U.S.C. 154(b) by 446 days.

(21) Appl. No.: 15/756,411

(22) PCT Filed: Sep. 2, 2016

(86) PCT No.: PCT/IB2016/055275
§ 371 (c)(1),
(2) Date: Feb. 28, 2018

(87) PCT Pub. No.: WO2017/037673
PCT Pub. Date: Mar. 9, 2017

(65) Prior Publication Data

US 2018/0249879 A1 Sep. 6, 2018

(30) Foreign Application Priority Data

Sep. 2, 2015 (IT) ..... 102015000047894

(51) Int. Cl.
*A47L 11/40* (2006.01)
*A47L 11/30* (2006.01)

(52) U.S. Cl.
CPC ..... *A47L 11/4088* (2013.01); *A47L 11/30* (2013.01); *A47L 11/4008* (2013.01); *A47L 11/4011* (2013.01)

(58) Field of Classification Search
CPC .. A47L 11/4088; A47L 11/30; A47L 11/4008; A47L 11/4011
See application file for complete search history.

(56) References Cited

U.S. PATENT DOCUMENTS 5,411,716 A * 5/1995 Thomas ..... A47L 11/03 134/7
8,551,262 B2 10/2013 Eklund et al. ..... 134/36

FOREIGN PATENT DOCUMENTS

EP 2 511 016 A2 4/2012
WO WO 2010/099968 A2 9/2010

* cited by examiner

*Primary Examiner* — Andrew A Horton
(74) *Attorney, Agent, or Firm* — Stein IP, LLC

(57) ABSTRACT

A surface treatment machine, comprising a frame configured to translate with respect to a surface to treat, a surface treatment element connected to said frame and configured to treat with liquid a surface, a reservoir connected to the frame arranged to provide liquid to the surface treatment element through a delivery mouth; an adjustment element arranged to feed adjustably the liquid supplied from the reservoir to the delivery mouth. It is then provided a sensor configured to measure the flow-rate of the liquid from said reservoir towards the delivery mouth. A control unit receives from the sensor a signal proportional to the flow-rate for adjusting the adjustment element responsive to this value, in order to deliver the liquid with optimization of the flow-rate. It is possible then to maximize the range of the machine, and to optimize the working time of the operator.

8 Claims, 6 Drawing Sheets

SURFACE TREATMENT MACHINE WITH FLOW-RATE CONTROL

CROSS-REFERENCE TO RELATED APPLICATIONS

This application is a national stage of International Application No. PCT/IB2016/055275 filed Sep. 2, 2016, which claims the benefit of Italian Application No. 102015000047894, filed Sep. 2, 2015, in the Italian Patent Office, the disclosures of which are incorporated herein in their entireties by reference.

FIELD OF THE INVENTION

The present invention relates to the surface treatment machines of the type having a surface treatment element configured to treat a surface with liquid.

Among such machines there are comprised both those of ride-on type and of walk-behind type, which can be either motorized or pushed, with a surface treatment element in the form of either a brush, disc, pad, spraying member.

DESCRIPTION OF THE PRIOR ART

Machines exist for treating surfaces with liquid that provide the application of the liquid by means of a treatment element, taking the liquid from a reservoir on board of the machine.

Once ended the liquid, the operator has to bring normally the machine to a point of replenishment, for filling again the reservoir.

In some cases the dirty liquid is collected from the surface by the machine, for example by a suction system, which is arranged to drain the liquid by suction up to a collection container on board of the machine. When the reservoir is emptied also the collection container is normally full, because the latter is sized according to the capacity of the reservoir.

The operators of such surface treatment machines, in case they have to cover wide surfaces, like the case for example of overnight cleaning of places like airports, hospitals, schools, offices, etc., have often the problem of not knowing, unless in very rough approximation, the amount of residual liquid in the reservoir, and then the range of the machine in terms of amount of surface that can be treated before making again a replenishment of liquid.

A precise knowledge of the range of the machine is desirable, because it would allow planning an optimal treatment route up to the nearest replenishment point before the treatment liquid ends.

In WO2010/099968A2 a machine for cleaning surfaces is described that provides a system for automatically calculating the range of the machine. It carries out a measurement of physical and kinematical quantities, in particular the speed of the machine, from which the ratio is calculated between the cleaned surface and the time necessary to clean it, responsive to many parameters indicated by the operator, like the size of the brush or the size of the nozzle for soaking the brush. The operator, by knowing the residual range of the machine, has a useful information for completing the route up to the next replenishment.

In the surface treatment machines with liquid treatment, it can occur that the delivery of liquid to the surface treatment element is not constant, and this does not allow to calculate precisely the range of the machine, with an easy knowledge of physical and kinematical quantities, as space, time, speed.

For example, in case of feeding the liquid by gravity, as the reservoir is progressively emptied the flow-rate of liquid to the treatment element changes. Even in case of feeding the liquid by means of a pump not of positive displacement type, which however would be heavier and expensive, the flow-rate of liquid to the surface treatment element can change, owing to leakages and to sensitivity of the pump at the supply pressure. The operator, then, in order ensure an effective treatment, i.e. with a sufficient amount of liquid versus treated surface, adjusts the opening value of the feeding duct section in such a way to ensure always an amount of liquid vis-a-vis treated surface that is enough for treatment, even in the most unfavorable situations. This determines, however, owing to unsteadiness of the flow-rate, a reduction of the range of the machine.

Furthermore, changing the speed of the surface treatment machines with respect to the surface to treat, there is a subsequent change of the amount of supplied liquid versus treated surface, and also this requires an adjustment of the feeding duct section, in order to ensure an amount of liquid that is sufficient also in case of maximum speed of the machine, with the consequence of reducing the range of the machine.

In U.S. Pat. No. 8,551,262 a chemical detergent is dosed with respect to water, taking into account the level in the water reservoir. A level sensor provides a signal of level that influences a controller of a positive displacement pump which feeds the chemical detergent. This way, the dilution in water of the chemical detergent is kept fixed regardless of the level of water in the reservoir.

In EP2511016 a surface treatment machine is described with a reservoir containing a cleaning liquid with a pump and a line of delivery that ends with a cleaning head. A bypass line deviates surplus detergent solution from the delivery mouth of the pump back towards the reservoir, in order to control the flow-rate supplied within predetermined threshold values.

SUMMARY OF THE INVENTION

It is a feature of the present invention to provide a surface treatment machine that ensures an effective treatment concerning the amount of liquid versus treated surface and in the meantime maximizes the range of the machine.

It is another feature of the invention to provide such a machine which permits controlling the delivery of liquid to the surface treatment element versus the level of liquid present in the reservoir for improving the range of the machine.

It is another feature of the invention to provide such a machine for maximizing the range of the machine responsive to a predetermined cleaning route follow.

It is also a feature of the present invention to provide such a machine that enables an operator to determine in real time the residual range of the machine.

These and other objects are achieved by a surface treatment machine, comprising:

- a frame configured to translate with respect to a surface to treat,
- a surface treatment element connected to the frame and configured to treat with liquid a surface with respect to which the frame advances,
- a reservoir connected to the frame and arranged to supply a liquid to the surface treatment element through a delivery mouth;

an adjustment element arranged to feed adjustably the liquid supplied from the reservoir to the delivery mouth;

a sensor configured to measure the liquid flow-rate travelling from the reservoir to the delivery mouth and to provide a signal proportional to an actual flow-rate;

a control unit configured to receive from the sensor said signal proportional to the actual flow-rate and to compare it with a predetermined threshold flow-rate, a program means, resident in said control unit and configured to set the adjustment element when the actual flow-rate diverges from the predetermined threshold flow-rate until the actual flow-rate reaches again said predetermined threshold flow-rate.

In a possible exemplary embodiment, the adjustment element is selected from the group consisting of:

a piloted valve, where the control unit is configured to adjust an opening rate of the valve in an increasing way responsive to decrease of the flow-rate;

a pump, where the control unit is configured to adjust the speed of the pump in an increasing way responsive to decrease of the flow-rate;

a display unit, configured to display said actual flow-rate signal indicating the residual volume of liquid in the reservoir and a value of residual range of the machine.

In this case, the control unit influences the adjustment element, i.e. the valve or the pump, so that there is a continuous feedback adjustment of the flow-rate, eliminating any causes that determine an undesired variation of the flow-rate with respect to ideal operation parameters, i.e. the predetermined threshold flow-rate set manually by the operator when adjusting the machine or as input starting parameter, optimizing the flow-rate, in order to achieve a maximum range of the machine.

Advantageously, an input/output unit is provided that is configured to display said signal indicating the actual flow-rate of liquid, and for receiving initial or determined flow-rate values.

In a possible exemplary embodiment, said control unit is configured to calculate, starting from actual flow-rate values determined with time, an accumulated value of delivered liquid, and for determining the residual range of the machine, on the basis of the difference between the capacity of the reservoir and the accumulated value of delivered liquid.

In this case, it is possible that the flow-rate sensor is a flow meter or liter counter, and the control unit has an integrator to calculate, by the actual flow-rate values, the volume of treatment liquid supplied up to a determined time, at which also the residual range of the machine is calculated.

The range of the machine can be expressed as volume of residual liquid in the reservoir, or as residual distance or residual surface to treat, calculated on the basis of initial or determined flow-rate values.

In a possible exemplary embodiment, the input/output unit is configured for receiving as input a liquid saving parameter, said control unit being configured for receiving said actual flow-rate signal and said liquid saving parameter, to calculate an optimum saving flow-rate and for adjusting the adjustment element responsive to said liquid saving parameter so that said adjustment element delivers a flow-rate coincident with said optimum saving flow-rate.

Such optimum saving flow-rate can be obtained as initial or determined flow-rate values adjusted on the basis of the liquid saving parameter.

This way, the operator can, according to the residual volume of liquid in the reservoir of the machine, set the residual range of the machine concerning for example the residual surface to treat or the treatment distance to be covered up to the next replenishment, so that the adjustment element provides a constant value of treatment liquid up to completion of the treatment according to the selected liquid saving parameter.

The machine can then deliver a constant amount of liquid taking into account both the liquid saving parameter selected by the operator for reaching the closest replenishment point, and the residual liquid present in the reservoir, since it influences the amount of supplied liquid responsively to the different head of the residual liquid at an outlet section of the reservoir, avoiding the undesirable effect of delivery affected by the level of liquid in the reservoir, optimizing the flow-rate, achieving the goal of maximizing the range of the machine responsive to the remaining space to be treated up to reaching a programmed replenishment point.

The liquid saving parameter can be indicated concerning volume of liquid versus treated surface, and can be for example positive, zero or negative, indicating if the machine must deliver more or less liquid with respect to a predetermined adjustment reference value. In this case, the control unit recalculates the residual range of the machine and the input/output unit displays such residual range of the machine, for verification by the operator. While continuing with the treatment, the residual range of the machine can be continuously updated and displayed to the operator. The liquid saving parameter can be expressed also directly as value of residual range of the machine that the operator wishes to achieve.

This way, there is an elimination of the undesirable effect that causes the variation of the flow-rate of supplied liquid to the surface treatment element versus the level of liquid present in the reservoir, and there is an optimization of the flow-rate according to the liquid saving parameter selected by the operator for reaching the closest replenishment point without stopping the treatment.

This adjusts the amount of supplied liquid, in order to have an ideal treatment efficiency without excessive or insufficient liquid supply, in order to maximize the range of the machine.

Advantageously, the input/output unit is associated with a display unit of the operating parameters and of a value of range of the machine calculated on the basis of instant values of the measurement of the volume of residual liquid present in the reservoir and of the selected liquid saving parameter.

This way, the operator is enabled to see on the display unit the values of residual range of the machine, versus time, or the residual surface to treat, in order to determine the optimal route that allows to reach a replenishment point without loss of time or covering useless routes. In case, during the route, the operator chooses to change the liquid saving parameter, this can be done, changing thus constant flow-rate value of dispensed treatment liquid.

In an embodiment the adjustment element is a piloted valve, and the reservoir is arranged with respect to the delivery mouth for delivering liquid to the surface treatment element by gravity through the valve.

This solution makes it possible to minimize the costs for making the machine, since it does not need a pump for delivering the liquid to the treatment element, but exploits simply the gravity, achieving the goal of avoiding the difficulty to control the amount of supplied liquid responsive to the treated surface.

Then, the operator is enabled to see on the display unit the values of residual range of the machine, versus time, or the residual surface to treat, and to set in turn the treatment route that allows maximizing the range of the machine and eventually making a replenishment without loss of time or covering useless routes.

BRIEF DESCRIPTION OF THE DRAWINGS

The invention will be now shown with the following description of an exemplary embodiment thereof, exemplifying but not limitative, with reference to the attached drawings in which.

DETAILED DESCRIPTION OF SOME EXEMPLARY EMBODIMENTS

Figure 1:
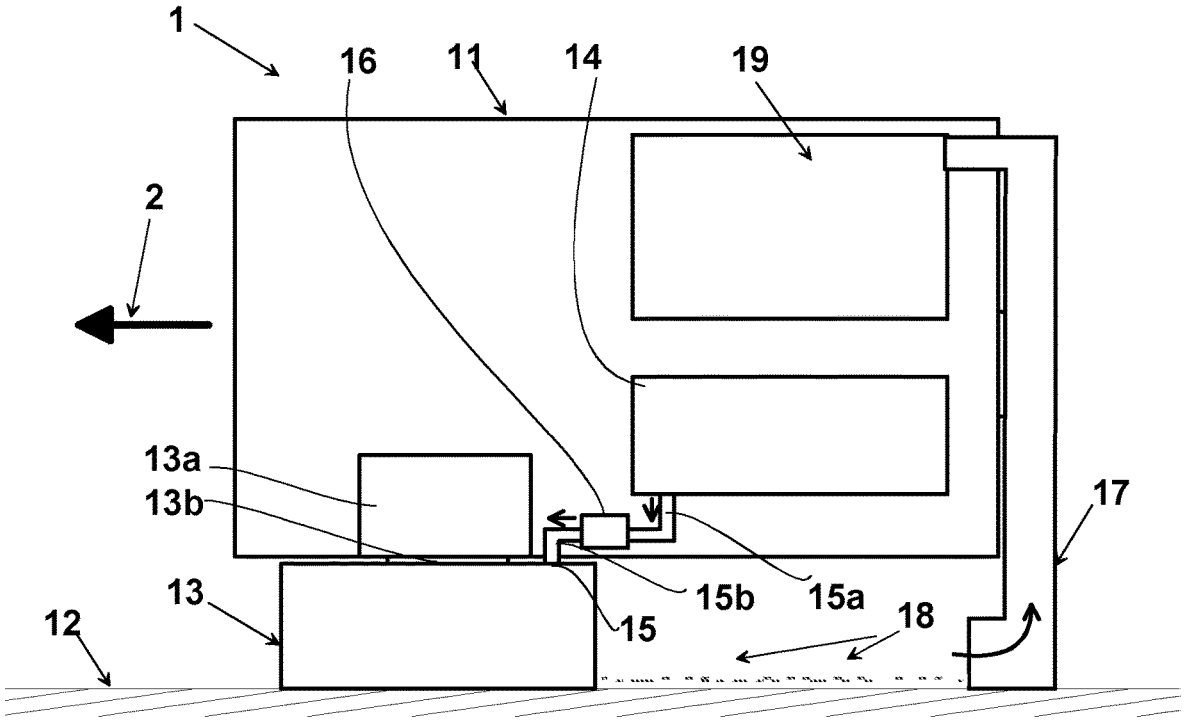
Fig. 1 (prior art)
FIG. 1 shows a block diagram of a generic surface treatment machine according to the prior art.

As shown in FIG. 1, a surface treatment machine, whose general layout is known and indicated as 1, comprises a frame 11 configured to translate with respect to a surface 12 to treat.

The translation, in the direction of arrow 2, can be carried out by pushing, through a handlebar or through separate handles (not shown), or in a motorized way, through wheels or tracks (not shown), and the machine can be of ride-on type or of walk-behind type. The surface 12 to treat can be a floor but it can also be vertical, such as the case of windows or vertical walls, with the machine moved on vertical guides or through lifting platforms (not shown).

Machine 1 comprises a surface treatment element 13, which is connected to the frame 11 and configured to treat with liquid surface 12, with respect to which the frame 11 advances.

The surface treatment element, indicated generally as block 13, can be a rotating brush or other brush element, as well as it can be a vibrating pad or other treatment element, for example a spray liquid distributor. A motor can be provided or other actuating element 13*a* for actuating a connecting element 13*b* linked to the surface treatment element 13, for example a rotating shaft.

Furthermore, machine 1 comprises a reservoir 14 connected to the frame 11 and arranged to supply a liquid to surface treatment element 13 through a delivery mouth 15. It is then provided an adjustment element 16 arranged to feed adjustably the liquid supplied from reservoir 14 to delivery mouth 15, and located between two branches 15*a* and 15*b* arranged for feeding the liquid from reservoir 14 to delivery mouth 15.

The treatment liquid in reservoir 14 can be water, water with detergent, pure detergent, or other treatment liquid, for example protecting film, coating film, etc. A further reservoir can also be provided which can contain a detergent to mix with the water before the delivery (not shown).

The adjustment element indicated generally with block 16 can be a valve or a pump. It can be simply an On/Off device or an adjustable device, for example an adjustable tap valve.

In FIG. 1 a collection element 17 is also shown, for example a squegee associated with a suction device, which is arranged to drain, as machine 1 progressively moves in the direction of arrow 2, the surplus treatment liquid 18 that soaks surface 12. Collection element 17 is connected hydraulically to a container 19 arranged for collecting residual liquid and possible dirt.

Collection element 17 can also be missing in certain models of machine.

In the rear zone of the machine wheels can be provided, not shown, driven or idle, both in the presence of collection element and without it.

Figure 2:
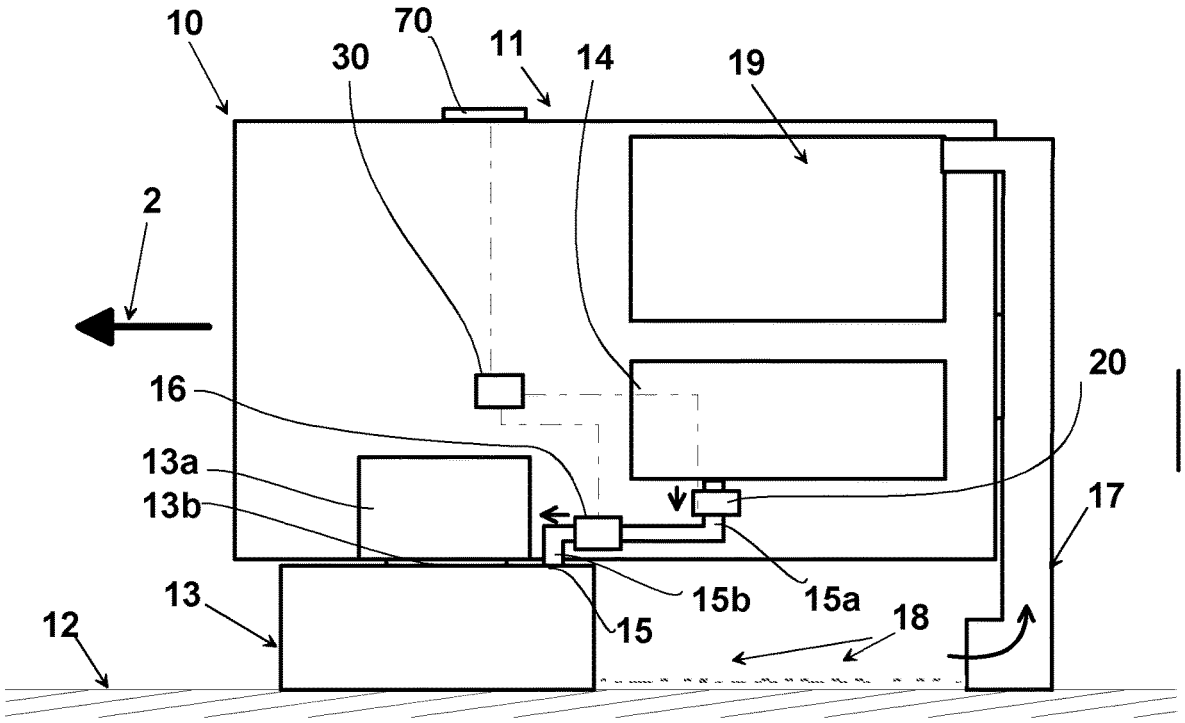
FIG. 2 shows a block diagram of a generic surface treatment machine according to the invention.

As shown in FIG. 2, according to the present invention, a surface treatment machine 10, starting from surface treatment machine 1 of FIG. 1, is modified in order to comprise an adjustment element 16 arranged to feed adjustably the liquid supplied by reservoir 14 to the delivery mouth. Adjustment element 16 can be, for example, an electrically operated adjustment valve, or an electric pump with adjustable speed.

Furthermore, it comprises a flow-rate sensor 20 configured to measure the liquid flow-rate travelling from the reservoir to the delivery mouth and to provide a signal proportional to an actual flow-rate.

It is provided a control unit 30 arranged to receive from sensor 20 a signal proportional to the flow-rate and configured to set adjustment element 16 responsive to the actual flow-rate, i.e. it is programmed for adjusting adjustment element 16 when the actual flow-rate is different from predetermined values.

In particular, control unit 30 receives by sensor 20 the signal proportional to an actual flow-rate and then compares it with a predetermined threshold flow-rate, obtained for manual adjustment of the machine or as starting default value of adjustment element 16, for example an initial opening duty cycle of the electrically operated adjustment valve, or an initial number of turns of the pump with electrically adjustable speed.

The flow-rate sensor 20 can be a liter counter or flow meter, which can be arranged in series to the duct 15*a* at the outlet of reservoir 14. Alternatively, it can be arranged in series to the duct 15*b* between adjustment element 16 and delivery mouth 15.

In this case, adjustment element 16 can be a piloted valve, where control unit 30 is configured to adjust an opening rate of the valve in an increasing way responsive to decrease of the flow-rate determined by sensor 20 up to return of the flow-rate to predetermined constant values.

Alternatively, adjustment element 16 can be a pump, where control unit 30 is configured to adjust the speed of the pump in an increasing way responsive to decrease of the flow-rate determined by sensor 20 up to return of the flow-rate to predetermined constant values.

In the control unit, for example, a servo-assistance function of adjustment element 16 can be recorded, which controls in a loop feedback, the flow-rate which is maintained constant on initial or determined flow-rate values, responsive to decrease of the amount of liquid in reservoir 14, increasing responsively the opening rate of the valve or the number of turns of the pump.

The measurement of residual liquid present in reservoir 14 is directly related to the integration with time of the instant flow-rate determined by sensor 20, if it is a flow meter, i.e. to values of accumulated liquid starting from initial and measured values. In fact, it is possible to calculate the volume of residual liquid in reservoir 14 and then the range of the machine, versus capacity of the reservoir, which at each replenishment is filled, by subtracting the accumulated value of liquid. The volume of residual liquid value can be, advantageously, displayed on the machine, as useful information for operator, indicated as residual liters/gallons, and/or as residual square or linear meters/feet that the machine can still treat.

To this purpose, according to a further exemplary embodiment of the figures, control unit 30 can be associated with a display unit 70 (FIGS. 2 and 3) configured to display the actual flow-rate signal indicating the residual volume of liquid in the reservoir and a value of residual range of the machine calculated on the basis of instant values determined by sensor 20.

Adjustment element 16 can be a valve, for example a piloted valve, and reservoir 14 can be arranged, with respect to delivery mouth 15, for delivering liquid to surface treatment element 13 by gravity through adjustment valve 16.

Figure 4:
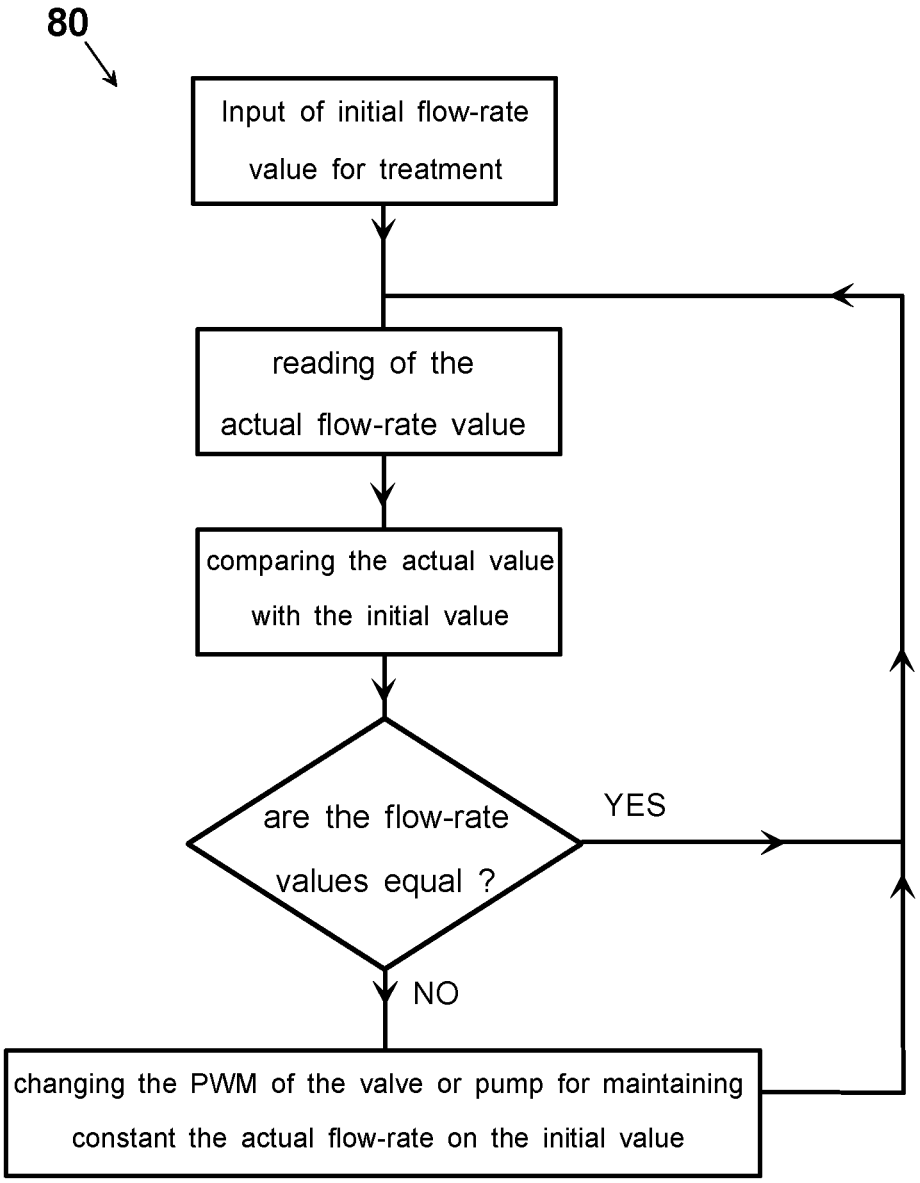
FIG. 4 shows a possible flow-sheet of the steps made by the program means resident in the control unit of the machine in a possible first configuration.

In control unit 30 a program can be resident that can control adjustment element 16, for example a solenoid valve or pump, in the form of changing the PWM, responsive to the actual flow-rate signal, as indicated in the flow chart 80 of FIG. 4. If the actual flow-rate value, determined by sensor 20, coincides with the initial or determined value, adjustment element 16, for example a solenoid valve or pump, is maintained on the current adjustment value values as duty cycle or number of turns. If instead flow-rate value present, determined by sensor 20, does not coincide with that starting or predetermined, then the PWM of the valve or pump is modified, for increasing the flow-rate. The change stops when the current flow-rate value, always determined by sensor 20, coincides again, approximately, to the starting or determined value.

Then, according to the invention, the control flow-rate feedback loop is essential to ensure an amount of supplied liquid that is constant, since the feeding by gravity is extremely affected by any variations of liquid level in the reservoir, since the liquid head that acts on adjustment element 16 would change unavoidably the response versus actual flow-rate supplied to the surface treatment element through mouth 15.

In particular, the operator can set a value of range of the machine so that up to the next replenishment the flow-rate of liquid is kept constant and all the liquid present in the reservoir is used.

Figure 3:
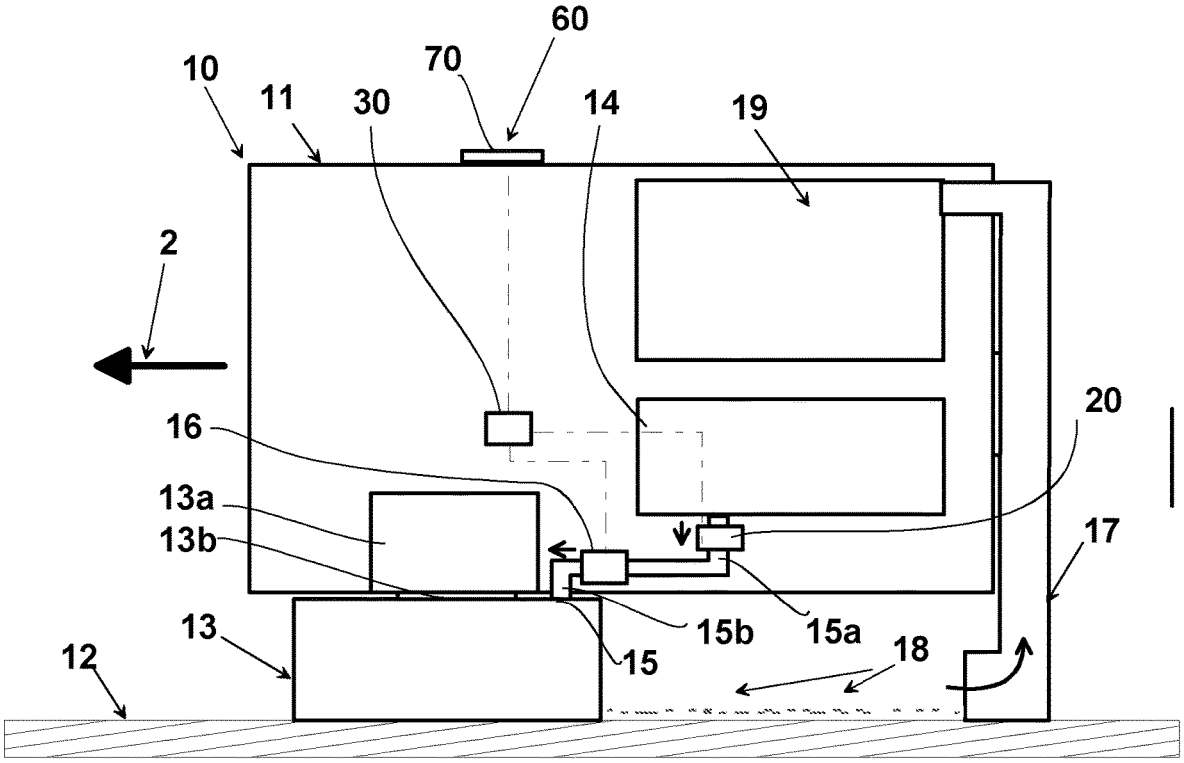
FIG. 3 shows an exemplary embodiment of the surface treatment machine of FIG. 2, with the addition of a input/output unit, with possible display unit.
Figure 5:
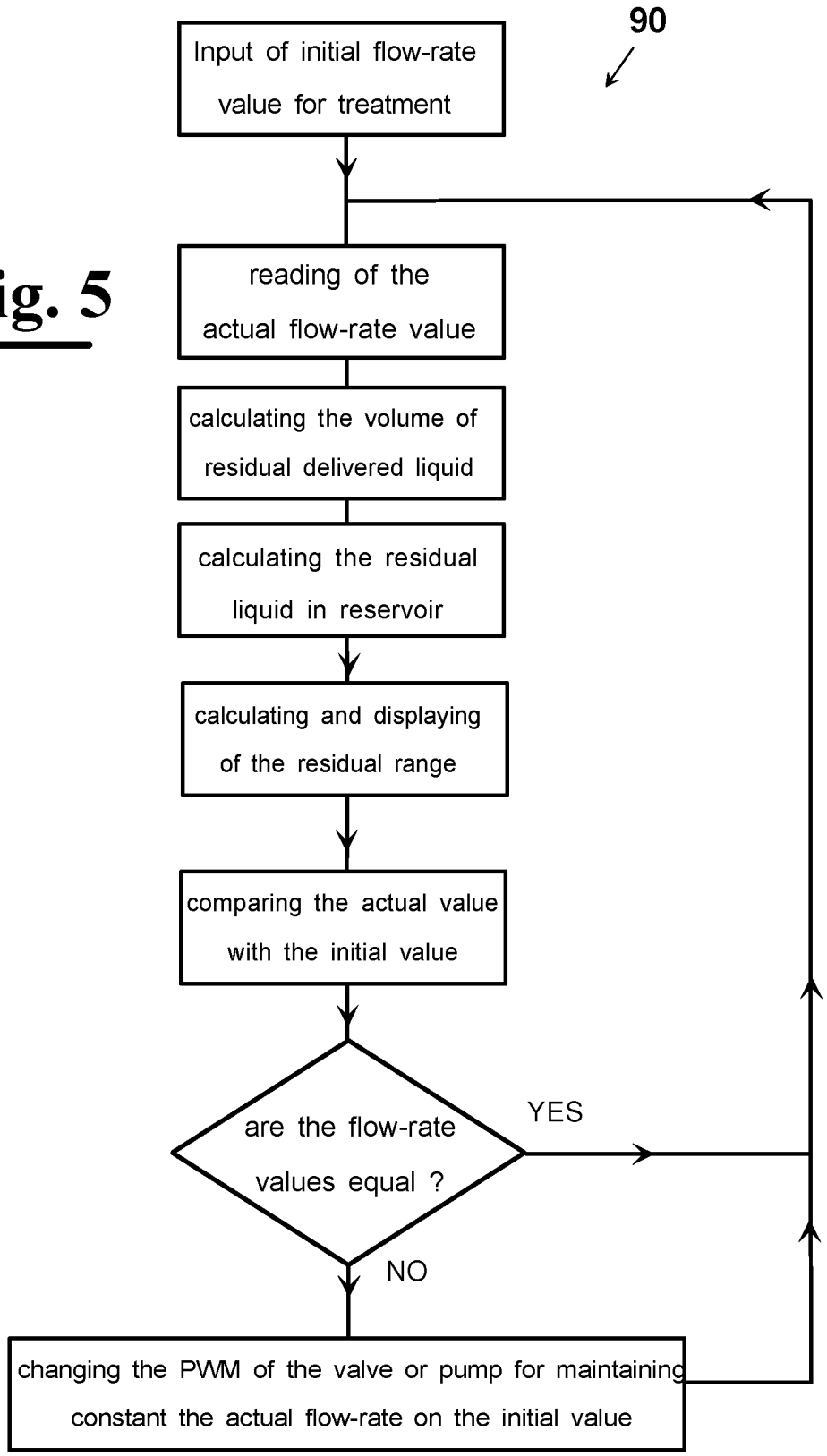
FIG. 5 shows a possible flow-sheet of the steps made by the program means resident in the control unit of the machine in a possible second configuration.

In order to achieve this goal, as shown in FIG. 3, surface treatment machine 10 can present, in a preferred exemplary embodiment, an input/output unit 70, connected to control unit 30, and arranged to display the actual flow-rate signal computed on the basis of a signal coming from sensor 20 as well as the residual range of the machine, calculated as above indicated. Display unit 70 comprises an input/output unit 60 for entering an initial flow-rate value that is displayed by display unit 70 with the residual volume of liquid in reservoir 14 and with the residual range of the machine (FIG. 3). In this case, the program present in control unit 30 can act as indicated by the flow-sheet 90 of FIG. 5.

By input/output unit 60, a liquid saving parameter can be entered, which can be communicated to control unit 30 with the flow-rate signal present.

Input/output unit 60 can also be used for entering a level measurement signal in the residual liquid in the reservoir that is displayed by the display unit 70.

Figure 6:
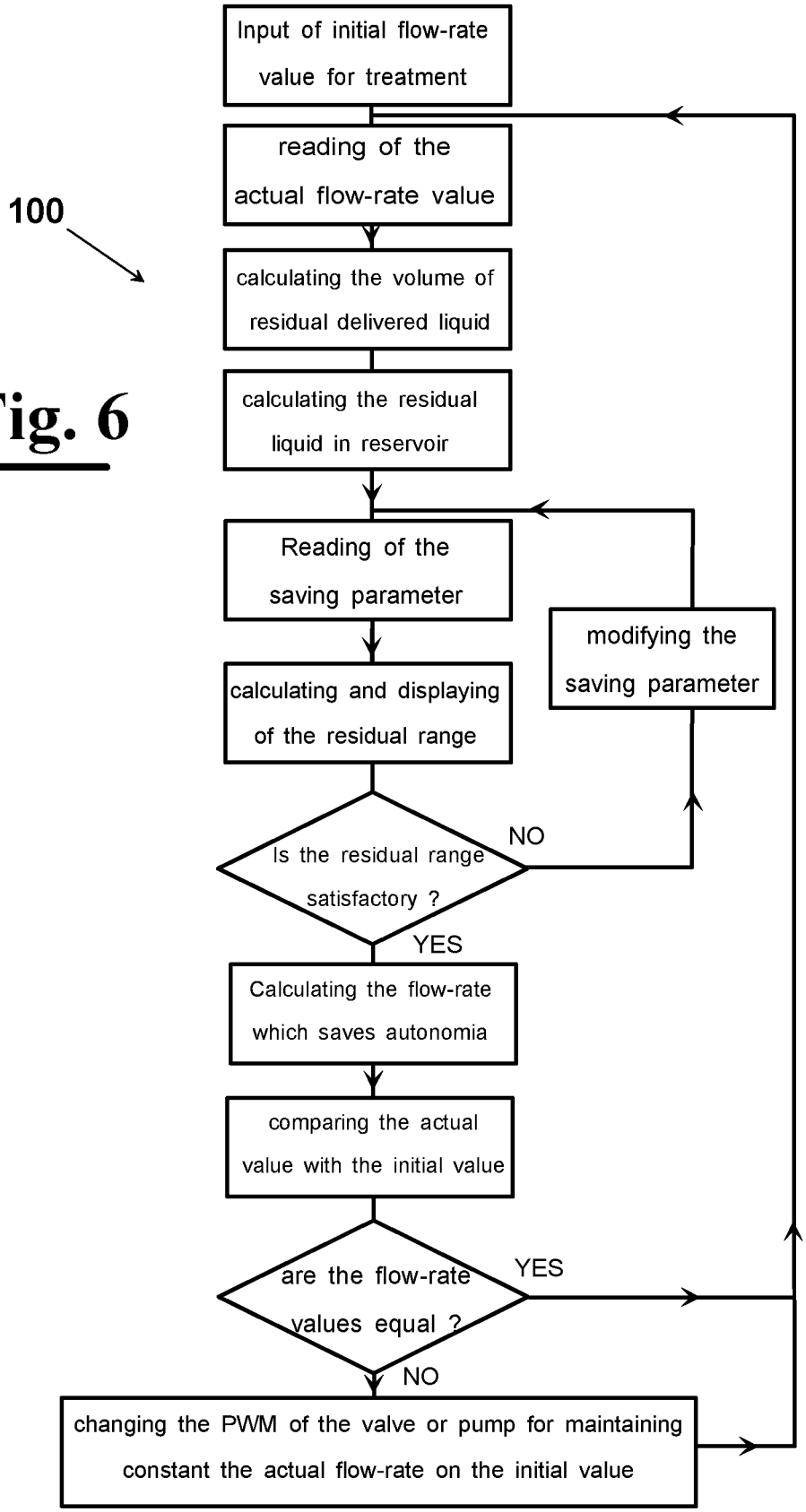
FIG. 6 shows a possible flow-sheet of the steps made by the program means resident in the control unit of the machine in a possible third configuration.

In the control unit a program means can be present that can control adjustment element 16, for example a solenoid valve or pump, in the form of changing the PWM, in function both of the actual flow-rate signal and of the liquid saving parameter. In this case, the program present in control unit 30 can act as indicated by the flow-sheet 100 of FIG. 6.

Then, the operator can, according to the residual liquid obtained by the measurement signal of sensor 20, to set the residual range of the machine, by input/output unit 60, concerning for example the residual surface to treat (for example square meters) or distance of treatment (for example linear meters) to be covered up to the next replenishment.

To adjustment element 16, then, control unit 30 can provide a constant value of treatment liquid up to completion of the treatment according to the selected liquid saving parameter.

In substance, in its possible configurations, machine 10, can, then, deliver a constant amount of liquid taking into account both the liquid saving parameter entered by the operator through the unit 70 for reaching the closest replenishment point, and the residual liquid present in reservoir 14, since it influences the amount of supplied liquid responsively to the different head of the residual liquid on adjustment element 16, at an outlet section of the reservoir, avoiding the undesirable effect of delivery affected by the level of liquid in reservoir 14, optimizing the flow-rate, achieving the goal of maximizing the range of the machine responsive to the remaining space to be treated up to reaching a programmed replenishment point.

The liquid saving parameter can be indicated concerning volume of liquid versus treated surface that can be delivered at mouth 15, and can be for example positive, zero or negative, indicating if machine 10 must deliver more or less liquid with respect to a predetermined adjustment reference value. In this case, control unit 30 recalculates the residual range of the machine and display unit 70 displays such residual range of the machine, for verification by the operator. While continuing with the treatment, the residual range of the machine can be continuously updated and displayed to the operator on unit 70. The liquid saving parameter can be expressed also directly as value of residual range of the machine that the operator wishes to achieve.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A surface treatment machine, comprising:

a frame configured to translate with respect to a surface to treat, a surface treatment element connected to said frame and configured to treat with liquid the surface with respect to which said frame advances, a reservoir connected to said frame and arranged to supply a liquid to said surface treatment element through a delivery mouth;

an adjustment element arranged to feed adjustably the liquid provided by said reservoir to said delivery mouth;

a sensor configured to measure the liquid flow-rate travelling from the reservoir to the delivery mouth and to provide a signal proportional to an actual flow-rate;

a control unit arranged to receive from said sensor said signal proportional to the actual flow-rate and to compare it with a predetermined threshold flow-rate, in said control unit a program means being resident configured to set the adjustment element when the actual flow-rate diverges from the predetermined threshold flow-rate until the actual flow-rate reaches again said predetermined threshold flow-rate, wherein a display unit is provided configured to display said actual flow-rate signal indicating the residual volume of liquid in the reservoir and a value of residual range of the machine.

2. Surface treatment machine according to claim 1, wherein said adjustment element is selected from the group consisting of:

a piloted valve, wherein said control unit is configured to adjust the opening said valve in an increasing way responsive to decrease of the level of liquid in said reservoir, an adjustable pump, wherein said control unit is configured to adjust the speed of said pump in an increasing way responsive to decrease of the level of liquid in said reservoir.

3. Surface treatment machine according to claim 1, wherein said flow-rate value is determined by said sensor as:

a value of volume versus time, and said sensor is a flow meter, from which a value of supplied liquid is obtained by a step of integration with time;

a value of volume, and said sensor is a flow meter, from which a flow-rate value is obtained by a step of derivation with time.

4. Surface treatment machine according to claim 1, wherein said display unit comprises an input/output unit for entering a flow-rate starting value, said display unit being configured to display said actual flow-rate signal indicating the residual volume of liquid in the reservoir and the value of residual range of the machine.

5. Surface treatment machine according to claim 1, wherein an input/output unit is provided for entering a starting flow-rate value and a liquid saving parameter, said display unit being configured to display said actual flow-rate signal indicating the residual volume of liquid in the reservoir and the value of residual range of the machine.

6. Surface treatment machine according to claim 1, wherein said display unit is configured to show a level measurement signal of residual liquid in said reservoir, a liquid saving parameter, and the value of residual range of the machine.

7. A method of treatment of surfaces, comprising the steps of:

translating a surface treatment machine with respect to a surface to treat, said machine having a surface treatment element connected to a frame;

feeding, at said surface treatment element, a treatment liquid, so that said surface treatment element treats with said liquid said surface during said translating;

said treatment liquid being drawn from a reservoir connected to said frame, in order to provide said liquid to said surface treatment element through a delivery mouth;

adjusting said delivery of liquid provided by said reservoir to said delivery mouth;

said method characterized in that it also comprises the steps of:

measuring by a sensor a flow-rate value of liquid travelling from the reservoir to the delivery mouth and to provide a signal proportional to an actual flow-rate, comparing said signal proportional to the actual flow-rate with a predetermined threshold flow-rate;

wherein said adjusting is done when the actual flow-rate diverges from the predetermined threshold flow-rate;

and in that a step is provided of:

displaying on a display unit said actual flow-rate signal, a residual volume of liquid in the reservoir and a value of residual range of the machine.

8. Method for treating surfaces, according to claim 1, comprising the further steps of:

introducing a liquid saving parameter related to the flow-rate of the liquid;

adjusting an adjustment element, on the basis of a signal proportional to said actual flow-rate signal and to said liquid saving parameter for delivering said liquid, in order to have an optimization of the flow-rate.

* * * * *